US006425229B2

(12) United States Patent
Sprenger et al.

(10) Patent No.: US 6,425,229 B2
(45) Date of Patent: Jul. 30, 2002

(54) SNAFFLE BIT WITH TWO SIDE RINGS AND A SHACKLE

(75) Inventors: Peter Sprenger; Valentin Völlmecke; Heinz Baumann, all of Iserlohn (DE)

(73) Assignee: Herm. Sprenger GmbH & Co. KG (DE)

( * ) Notice: Subject to any disclaimer, the term of this patent is extended or adjusted under 35 U.S.C. 154(b) by 0 days.

(21) Appl. No.: 09/881,864

(22) Filed: Jun. 15, 2001

Related U.S. Application Data

(63) Continuation of application No. PCT/DE99/02545, filed on Aug. 13, 1999.

(30) Foreign Application Priority Data

Dec. 16, 1998 (DE) ..... 198 58 132

(51) Int. Cl.[7] ..... B68B 1/06

(52) U.S. Cl. ..... 54/9

(58) Field of Search ..... 54/7, 8, 9

(56) References Cited

U.S. PATENT DOCUMENTS

| | | | | | |
|---|---|---|---|---|---|
| 800,381 | A | * | 9/1905 | Malke | 54/8 |
| 895,419 | A | * | 8/1908 | Bristol | 54/8 |
| 4,005,564 | A | | 2/1977 | Simington | |
| 4,375,147 | A | * | 3/1983 | Conrad | 54/8 |
| 4,941,312 | A | * | 7/1990 | Old, Sr. | 54/8 |

FOREIGN PATENT DOCUMENTS

| | | |
|---|---|---|
| DE | 914071 | 6/1954 |
| EP | 0017959 A1 | 10/1980 |

* cited by examiner

*Primary Examiner*—Robert P. Swiatek
(74) *Attorney, Agent, or Firm*—Akerman Senterfitt

(57) ABSTRACT

The snaffle bit for a horse has two side rings and a shackle arranged between the two side rings. The shackle is provided with tow side portions and has at least one joint. The at least one joint defines an articulation axis. A bore is arranged in the end area of each of the side portions that is remote from the at least one joint and receives with play a respective one of the two side rings. The axes of the two bores defines a plane that is inclined at an angle of 45°±20°, preferably of 45°±10°, to the articulation axis of the at least one joint.

15 Claims, 1 Drawing Sheet

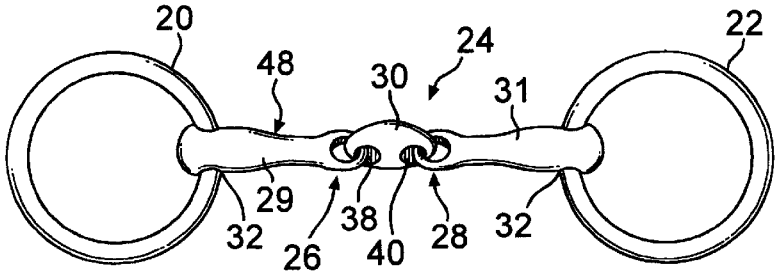
FIG. 1
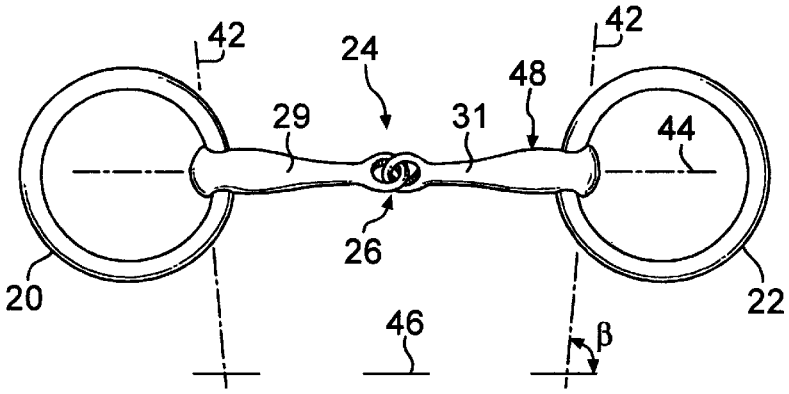
FIG. 2
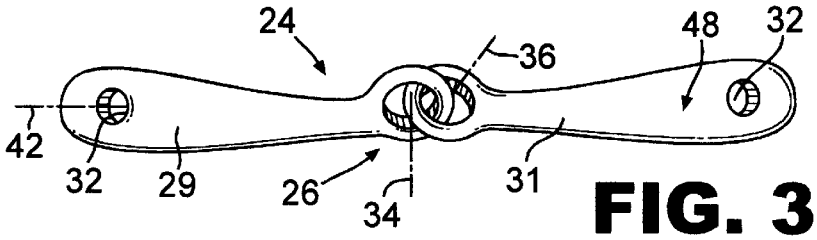
FIG. 3
FIG. 4
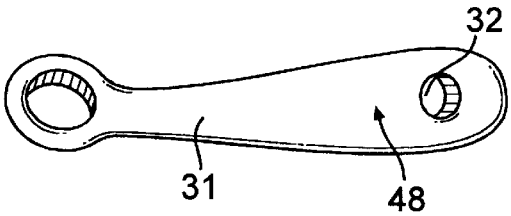

SNAFFLE BIT WITH TWO SIDE RINGS AND A SHACKLE

CROSS-REFERENCE TO RELATED APPLICATIONS

This is a continuation of PCT International Application No. PCT/DE99/02545, filed Aug. 13, 1999.

The invention relates to a snaffle bit for a horse with two side rings and one shackle arranged between said rings, said shackle having at least one joint on one side and being provided on the other with two side portions, a bore being provided in the end of each of the side portions that is remote from the at least one joint, said bore receiving a respective one of the rings in such a manner as to allow said rings to move freely.

This type of a snaffle bit for a horse forms the subject of the European Patent 17 959. In principle, this snaffle bit proved to be very appropriate. Reference is also made to the snaffle bits cited in this European Patent, more specifically to those according to U.S. Pat. No. 4,005,564; GB-A-7712/1914; GB-A-651913 and DE-C-194 071.

In devising the snaffle bit previously proposed and mentioned herein above, it proved particularly efficient to design the shackle so as to be even, smooth in contour and without edges and to have the transitions between discrete portions of the shackle made soft. It also proved very advantageous to have the section of the side portions tapering from the rings inward and this advantage will be retained. The same is true for the curved design of the shackle according to which a median line of the shackle that connects the bores intended to receive the two rings in such a manner as to provide them with freedom of movement is curved toward the front, toward the roof of the mouth. With the bit of the type mentioned above, this feature is achieved in providing the shackle with a joint so that a curved shape can be achieved.

Bits which have a jointed shackle will be designated herein after as "single joint" snaffle bits, and bits which have a shackle with two joints as "double joint" snaffle bits. These two embodiments of the snaffle bit for horses of the type mentioned herein above have come to be highly appreciated by horsemen.

The present invention would like to retain the major features of the snaffle bit of the type mentioned herein above and to develop it in such a way that it is even more suited and advantageous for a horse and fits better in its mouth. With the snaffle bit of the type mentioned herein above it has been found that the pressure exerted through pulling on the reins not always acts on the horse's tongue only, but in parts also on the roof of the mouth. But pressure onto the roof of the mouth is precisely what is not wanted.

This is where the invention comes to effect. It is its object to develop the snaffle bit of the type mentioned herein above in such a manner that, for a horse, the fit is improved and that pulling on the reins substantially acts on the tongue, the pull being initiated by way of the rings. It aims at ensuring that the bit adjusts in the best possible way to the anatomy of a horse's mouth.

Starting from the snaffle bit of the type mentioned above, the solution of this object is achieved in that the axes of the two bores define a plane that is inclined at an angle of 45°±20°, preferably of 45°±10°, to the articulation axis of the at least one joint.

Whereas in the previously proposed snaffle bit the articulation axes of the shackle's joints are lying in the plane that is defined by the bores for the rings, the angular position of the articulation axes of the joints permitting but a small deviation from this plane, the invention adopts just the opposite way. It intentionally arranges the articulation axes of the at least one joint of the shackle at an angle of 45°±20° to the plane of the bores. As a result, the bit is provided articulateness in a second plane which is inclined at an angle of 45° to the plane of the bores. As a result thereof, the bit can better adjust in space to a horse's mouth and has higher degrees of freedom of movement than the snaffle bit of the prior art cited herein above.

Tests have shown that this bit has a considerably improved fit, that it reinforces the action onto the tongue of the horse and better adjusts to the anatomy of the horse's mouth.

In a preferred embodiment, the snaffle bit of the invention has one or two joints. Although three or even more joints may also be provided, the embodiments of preference have one or two joints.

Moreover, it proved very advantageous to manufacture the bit according to the invention in the same way as the previously proposed bit mentioned herein above from an alloy as it has been described in the German Patent DE 43 26 550 C1 that contains a high amount of copper and still has a high mechanical strength.

In principle, the design of the joints is discretional. It is possible to have recourse to the embodiments as they have been described in the European Patent mentioned herein above and in the remaining state of the art. Simple designs of the joints however proved particularly efficient, namely such in which the joints are substantially defined by the interlock of two rings. As a joint, such joints have greater freedom of movement than joints that are defined by a rigid articulation axis and that allow the two portions joined by the axis of the joint to merely move in one plane relative to one another. In that the joints are designed as rings, soft transitions are additionally achieved. This allows ease of manufacture. Maintenance and cleaning are easy since the discrete hollow spaces are readily accessible. Furthermore, additional materials for making the joint move in a smooth way are not required. Eventually, this design of the joints excludes the risk of jamming the tongue of the horse and so on.

In a preferred embodiment, the central portion of a bit with two joints has two paralleled bores for forming the two joints of the shackle. It is however also absolutely possible to provide the central portion with two bores that are positioned at right angles to one another.

It proved particularly advantageous to make the central portion of a bit with two joints the shortest possible. Central portions with a maximum length of 4 cm, more specifically of 3 cm, proved appropriate. In bits with only one single joint, a short central region resembling a central portion is realized in that the unique joint provided there is thicker than the adjacent regions so that the shortness of less than 4, resp. 3, 2 or below 1 cm needed and required above is achieved.

In another preferred embodiment, when the bit is normally positioned, the two axes of the bores for the rings are not parallel to each other on a plane, they are rather positioned at an angle of less than 90° to the longitudinal axis of the shackle although they are lying in one plane. Their relative position forms a V. As a result thereof and depending upon the orientation of the bit in the horse's mouth, the pressure exerted on the tongue is reinforced when the reins are pulled. In that the bores are no longer relatively right-angled, a component of movement is introduced into the bit upon pulling on the reins that has positive effects which more specifically consist in that the tongue is strained in a much better way.

In the embodiment as it has been described above it proved advantageous when the axes of the bores of a snaffle bit placed in a horse's mouth intersect underneath the horse's tongue, i.e., below its chin. The desired positive strain on the tongue is thus preferably exerted. It is however absolutely possible to arrange the bores in exactly the opposite way. The arrangement also depends on the angular position of the main articulation axes of the at least one joint of the shackle. In accordance with these articulation axes, the bores are made so oblique that the desired positive strain on the tongue is achieved.

It eventually proved advantageous to thicken the central portion as compared to the adjacent side portions. The side portions taper from the rings inward as they do in the prior art bits. In the central region, increased thickness is again achieved. Accordingly, the smallest thickness is found between the central region and the rings. This shape is possible and wanted for the snaffle bit with one joint as well as for the snaffle bit with two joints.

In the entire specification of the invention, the terms top, bottom, front and rear refer to the position of the bit in a horse's mouth when the horse holds his head in a normal position. Accordingly, the "top" means the region near the horse's ears, "bottom" refers to the region of the mouth opening, "front" to the region of the nasal bone and "rear" to the region of the lower jaw.

Further advantages and characteristics of the invention will become apparent in the remaining claims as well as in the following description of exemplary embodiments of the invention that are not limiting the scope of the invention and that are explained in more detail with reference to the drawing. In the drawing's FIG. 1: shows a rear view of a snaffle bit for a horse with two joints, FIG. 2: shows a view according to FIG. 1 for a snaffle bit for a horse with one single joint, FIG. 3: shows a view rotated to 90° from the representation in FIG. 2 that shows the shackle only, that is, without the rings, the representation corresponding to a view from the bottom onto the corresponding parts of FIG. 2 and FIG: 4: shows a representation according to FIG. 3 for one single side portion of the bit according to FIG. 2.

As can be surveyed from the FIGS. 1 and 2, the snaffle bit for a horse has two side rings 20, 22 and a shackle 24 arranged between said two rings 20, 22. In the exemplary embodiment according to FIG. 1 it has two joints, in the exemplary embodiment according to the FIGS. 2 through 4 it has one single joint. Accordingly, the exemplary embodiment according to FIG. 1 has two joints 26, 28 that are located at either end of a central portion 30 whereas the shackle of the second exemplary embodiment has one single joint 26.

The shackle 24 has two side portions 29, 31. In the side portions, bores 32 are provided for each receiving a respective one of the rings 20 and 22 in such a manner as to allow said rings to move freely. The angular position of these bores 32 will be discussed later. These two bores 32 at the free end regions of the shackle 24 define a plane that coincides with the plane of the sheet in the representation according to the FIGS. 1 and 2. In the illustration according to FIG. 3, this plane is normal to the plane of the paper.

In the exemplary embodiments illustrated in the Figures, the joints 26, 28 are each designed as eyes that interlock with play, said eyes being provided at the inner end regions of the side portions 29, 31 or, with the bit that has two joints, at the central portion 30. This specific design of the joints 26, 28 provides the thus connected parts with a limited three-dimensional range of movement. The center of the allowable range of the joint is understood to be the articulation axis. It substantially corresponds to the spatial position of a centrical axis through an eye. The articulation axis is indicated in FIG. 3 by a dot-dash line at 34. The specific design of the joint that consists of two interlocking eyes provides a second articulation axis 36 that is arranged at right angles thereto. It is indicated in FIG. 3 by a dot-dash line 36. Both axes are inclined at an angle of 45° to the plane of the bores 32 and accordingly to the plane of the paper in FIG. 3.

For a better representation, in the embodiment according to the FIGS. 2 through 4, the free inner section of the hole of each eye is relatively large as compared to the section of the ring that constitutes the eye, so that the joints 26 also have large play in longitudinal direction of the side portions 29, 31 for example. The representation is thus easier to understand. In practical realization however, the clear spaces are smaller. The section of the ring fills at least half of the hole of the eye, preferably more, as may be surveyed from FIG. 1. In a preferred embodiment, the ring section is larger than 70% of the free section of the eye's hole, 80% are also possible, and 90% as well.

In the embodiment according to FIG. 1, the central portion 30 has two paralleled joint bores 38, 40. In another embodiment, these joint bores may also be relatively right-angled. In the representation according to FIG. 1, these two bores are spaced from each other by a relatively short distance, of between 2 and 3 cm for example. As a result thereof, the overall central portion 30 is quite short, it is a maximum of 4 cm in length and preferably a maximum of 3 cm in length. It is markedly thicker than the adjacent region of the side portions so that the already mentioned larger cross section in the center of the shackle 24 is obtained. In both exemplary embodiments, the cross section of the shackle 24 diminishes symmetrically to both sides and thickens again in the region of the bore 32 to attain a thickness which is comparable to the thickness in the center.

In FIG. 1, the central portion 30 has the shape of an olive. It may also have another design and for example be a disk at which sides two eyes axially protrude, a rod, of a rather spherical form, and so on.

As can more particularly be surveyed from the FIGS. 3 and 4, the side portions are curved. This is particularly obvious in FIG. 4 that shows that the overall central portion 30 lies on a slight arch. The shape of this arch is chosen to be such that the center of the shackle 24 in the horse's mouth extends more downward than the other parts of the shackle.

As can be particularly surveyed from FIG. 2, the two bores 32 are each positioned not at right angles to the longitudinal direction of the side portions, but at an angle beta which is not equal to 90°, more specifically at an angle of beta=60 to 85°. This can be seen from FIG. 2. FIG. 2 shows that the bores 32 penetrate the free outer ends of the side portions at a slant angle, the axes of the bores 32 are indicated by a dot-dash line at 42.44 is a straight dot-dash connecting line through the free end regions of the side portions. The dot-dash straight line 46 is parallel to the straight line 44 and was drawn to better illustrate the angles of intersection with the axes 42. FIG. 2 shows that the axes 42 are inclined at an angle beta of approximately 82° to the straight line 46. The two axes 42 thereby intersect at the rear. It can be seen that, irrespective of the concrete embodiment of the joint, the arrangement exhibits 2-fold symmetry to a median line.

Unlike the existing state of the art snaffle bits for a horse, the snaffle bit according to the invention has one side that should customarily lie in front. It is indicated by the arrow 48 in the FIGS. 1 and 2. In practical embodiments of the bits, the corresponding areas of at least one portion, of a side portion for example, are labeled accordingly, with "front" for example.

Depending on its construction, the bit of the previously proposed type only adopts a favorable position in the cavity of the horse's mouth when the reins are either eased or taken. The improvement is effected by the fact that the novel bit evenly adapts to the spatial conditions in the cavity of the horse's mouth whether the reins are eased or taken.

What is claimed is:

1. A snaffle bit for a horse comprising in combination:

two side rings;

a shackle that is arranged between said side rings, said shackle being provided with two side portions and having at least one joint, said at least one joint having an articulation axis; and two bores, each bore of said two bores being provided in an end area of one of the two side portions which end area is remote from the at least one joint, each bore of said two bores receiving one of the two side rings and allowing said one of the two side rings to move freely within said bore, each bore defining a bore axis, the bore axes of the two bores defining a plane, said plane being inclined at an angle of 45°±20° to the articulation axis of the at least one joint.

2. A snaffle bit as defined in claim 1, wherein the shackle is provided with more than one joint, each of the more than one joints having an articulation axis, all articulation axes of the joints being parallel to each other.

3. A snaffle bit as defined in claim 1, wherein the shackle is provided with a central portion and with two joints.

4. A snaffle bit as defined in claim 3, wherein the central portion has two paralleled joint holes for forming the two joints.

5. A snaffle bit as defined in claim 3, wherein the central portion has a length, said length being not more than 4 cm.

6. A snaffle bit as defined in claim 3, wherein the central portion has two holes, each of said two holes having a median line, the median lines of said two holes being less than 2.5 cm apart.

7. A snaffle bit as defined in claim 3, wherein the central portion of the shackle is thicker than adjacent regions of the side portions.

8. A snaffle bit as defined in claim 3, wherein the central portion is a maximum of 3 cm in length.

9. A snaffle bit as defined in claim 3, wherein the central portion has two holes, each of said two holes having a median line, the median lines of said two holes being less than 2 cm apart.

10. A snaffle bit as defined in claim 1, wherein the at least one joint is designed as two eyes which two eyes interlock with play.

11. A snaffle bit as defined in claim 1, wherein said plane is inclined at an angle of 45°±10° to the articulation axis of the at least one joint.

12. A snaffle bit as defined in claim 1, wherein the shackle is provided with but one single joint.

13. A snaffle bit for a horse, comprising:

two side rings;

a shackle arranged between said side rings, said shackle provided with two side portions and having at least one joint, said at least one joint having an articulation axis; and two bores, each of said two bores being provided in an end area of one of the two side portions, wherein said end area is remote from the at least one joint, each bore of said two bores receiving one of the two side rings and allowing said one of the two side rings to move freely within said bore, each bore defining a bore axis, the bore axes of the two bores defining a plane, said plane being inclined at an angle of 45°±20° to the articulation axis of the at least one joint;

wherein the shackle has a longitudinal axis and when the shackle is in a stretched configuration, in said plane each of the two axes of the two bores defines an angle of less than 90° with the longitudinal axis of the shackle, the two axes of the bores defining equal angles with the longitudinal axis.

14. A snaffle bit for a horse, comprising:

two side rings;

a shackle that is arranged between said side rings, said shackle being provided with two side portions and having at least one joint, said at least one joint having an articulation axis; and two bores, each bore of said two bores being provided in an end area of one of the two side portions which end area is remote from the at least one joint, each bore of said two bores receiving one of the two side rings and allowing said one of the two side rings to move freely within said bore, each bore defining a bore axis, the bore axes of the two bores defining a plane, said plane being inclined at an angle of 45°±20° to the articulation axis of the at least one joint, wherein the shackle has a longitudinal axis and when the shackle is in a stretched configuration, in said plane each of the two axes of the two bores defines an angle of less than 90° with the longitudinal axis of the shackle, the two axes of the bores defining equal angles with the longitudinal axis, and wherein, when a snaffle bit is placed in a horse's mouth, the axes of the two bores intersect underneath the horse's tongue.

15. A snaffle bit for a horse, comprising:

two side rings;

a shackle arranged between said side rings, said shackle provided with two side portions and having at least one joint, said at least one joint having an articulation axis; and two bores, each of said two bores provided in an end area of one of the two side portions, wherein said end area is remote from the at least one joint, each bore of said two bores receiving one of the two side rings and allowing said one of the two side rings to move freely within said bore, each bore defining a bore axis, the bore axes of the two bores defining a plane, said plane being inclined at an angle of 45°±20° to the articulation axis of the at least one joint;

wherein the shackle has a longitudinal axis and when the shackle is in a stretched configuration, in said plane each of the two axes of the two bores defines an angle of less than 90° with the longitudinal axis of the shackle, the two axes of the bores defining equal angles with the longitudinal axis; and wherein in said plane the angle between each of the two axes of the bores and the longitudinal axis of the shackle is an angle of between 60° and 85°.

* * * * *